US008668575B2

(12) United States Patent
Roach

(10) Patent No.: US 8,668,575 B2
(45) **Date of Patent: *Mar. 11, 2014**

(54) GAMING MACHINE WITH GAMBLE OPTION

(75) Inventor: Nick Graham Roach, Wentworth Falls (AU)

(73) Assignee: Aristocrat Technologies Australia Pty Limited (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/456,984

(22) Filed: Apr. 26, 2012

(65) Prior Publication Data

US 2012/0208632 A1 Aug. 16, 2012

Related U.S. Application Data

(63) Continuation of application No. 12/205,591, filed on Sep. 5, 2008, now Pat. No. 8,192,274.

(30) Foreign Application Priority Data

Sep. 6, 2007 (AU) ..... 2007904830

(51) Int. Cl.
*A63F 9/24* (2006.01)

(52) U.S. Cl.
USPC ..... 463/20; 463/25

(58) Field of Classification Search
USPC ..... 463/16–20, 25–30
See application file for complete search history.

(56) References Cited

U.S. PATENT DOCUMENTS

| | | | |
|---|---|---|---|
| 6,488,280 | B1 | 12/2002 | Katz et al. |
| 6,676,516 | B2 | 1/2004 | Baerlocher et al. |
| 7,731,582 | B2 | 6/2010 | Randall et al. |
| 2004/0038729 | A1 | 2/2004 | Webb et al. |
| 2004/0176157 | A1 | 9/2004 | Walker et al. |
| 2006/0063582 | A1 | 3/2006 | Baerlocher et al. |
| 2006/0073870 | A1 | 4/2006 | Cannon |
| 2007/0149276 | A1 | 6/2007 | Iwamoto et al. |
| 2008/0076514 | A1 | 3/2008 | Baerlocher et al. |
| 2008/0076517 | A1 | 3/2008 | Baerlocher et al. |
| 2008/0076552 | A1 | 3/2008 | Baerlocher et al. |
| 2009/0117989 | A1 | 5/2009 | Arezina et al. |
| 2009/0191964 | A9 | 7/2009 | Baerlocher et al. |

*Primary Examiner* — Masud Ahmed
(74) *Attorney, Agent, or Firm* — McAndrews, Held & Malloy, Ltd.

(57) ABSTRACT

A gaming machine provides a plurality of game levels, each level providing a plurality of symbols selectable by the player. A value associated with a selected symbol is used to calculate a winning value. The player may choose either the winning value or else play the next level.

6 Claims, 8 Drawing Sheets

GAMING MACHINE WITH GAMBLE OPTION

This application claims priority to, and is a continuation of, U.S. patent application Ser. No. 12/205,591, filed Sep. 5, 2008, which is incorporated herein by reference, and which claims priority to Australian Provisional Patent Application No. 2007904830 filed Sep. 6, 2007, which is also incorporated herein by reference in its entirety.

BACKGROUND OF THE INVENTION

The present invention generally relates to gaming machines and methods of gaming. A particular embodiment of the present invention relates to a gaming machine with a gamble option.

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought after variety, while still developing games that comply with the relevant regulations in the jurisdiction of the gaming venue operator. Suppliers of gaming devices therefore are faced with restrictions on the types of games and gaming machines that are allowable, both in terms of the prevailing regulations and in terms of providing a return on investment to the gaming venue operators.

BRIEF SUMMARY OF THE INVENTION

According to a first aspect, the present invention broadly resides in a gaming machine including a user interface and a game controller in communication with the user interface, the game controller providing a game in response to the staking of a wager by a player, the game including a plurality of levels, each level having an associated prize pool, and during play of a level the player selects a symbol from a plurality of symbols displayed by the game controller, wherein if the symbol selected by the player has an associated symbol value the gaming machine calculates a winning value and offers the player the choice of taking the winning value or progressing to a next level, wherein the winning value is calculated using at least one value associated with at least one of the plurality of symbols, and if the player elects to progress to the next level, the prize pool of the next level is calculated using at least one value associated with a completed level.

According to a second aspect, the invention broadly resides in a method for use with a gaming machine that, in response to the staking of a wager by a player, is arranged to play a game including a plurality of levels, each level having an associated prize pool, and during play of a level the player selects a symbol from a plurality of symbols displayed by the game controller, wherein if the symbol selected by the player has an associated symbol value a winning value is calculated and offered and the player is offered the choice of taking the winning value or progressing to a next level, wherein the winning value is calculated using at least one value associated with a at least one of the plurality of symbols, and if the player elects to progress to the next level, the prize pool of the next level is calculated using at least one value associated with a completed level.

At least one of the plurality of symbols may be at least one of the non-selected symbols.

At least one of the plurality of symbols may alternatively be a selected symbol.

The winning value and/or the prize pool of the next level may be calculated using all values associated with non-selected symbols. The calculation of the winning value and/or the prize pool of the next level may be calculated using the sum of all values associated with non-selected symbols.

Each level of the game may be played with the same number of symbols. The number of symbols to be used in each level may be selectable by the player prior to beginning game play, the number of symbols selected determining the prize pool for the first level of the game.

The calculation of the winning value for a level may also take into account the wager. Each level may also have an associated award multiplier, the award multiplier for a certain level also used in the calculation of the winning value for that level. The award multiplier may increase each time a player elects to progress to a further level.

In at least one level at least one symbol need not have an associated value, and if that symbol is selected by the player no winning value is calculated and play of the game is terminated. Alternatively, if a symbol with no associated value is selected the player may be provided with the option of returning to a previous level.

The number of levels in the game may be finite, and if the player is playing the final level and selects a symbol with an associated value the player is awarded a major prize and play of the game is terminated.

The game may either be a stand alone game, or may be accessed through play of an additional and different base game.

According to third aspect, the invention broadly resides in instructions executable by a game controller to implement the game as described in the immediately preceding paragraphs and to such instructions when stored in a storage medium readable by the game controller.

Further aspects of the present invention and further embodiments of the aspects described in the preceding paragraphs will become apparent from the following description, given by way of example and with reference to the accompanying drawings.

DETAILED DESCRIPTION OF THE INVENTION

Figure 1:
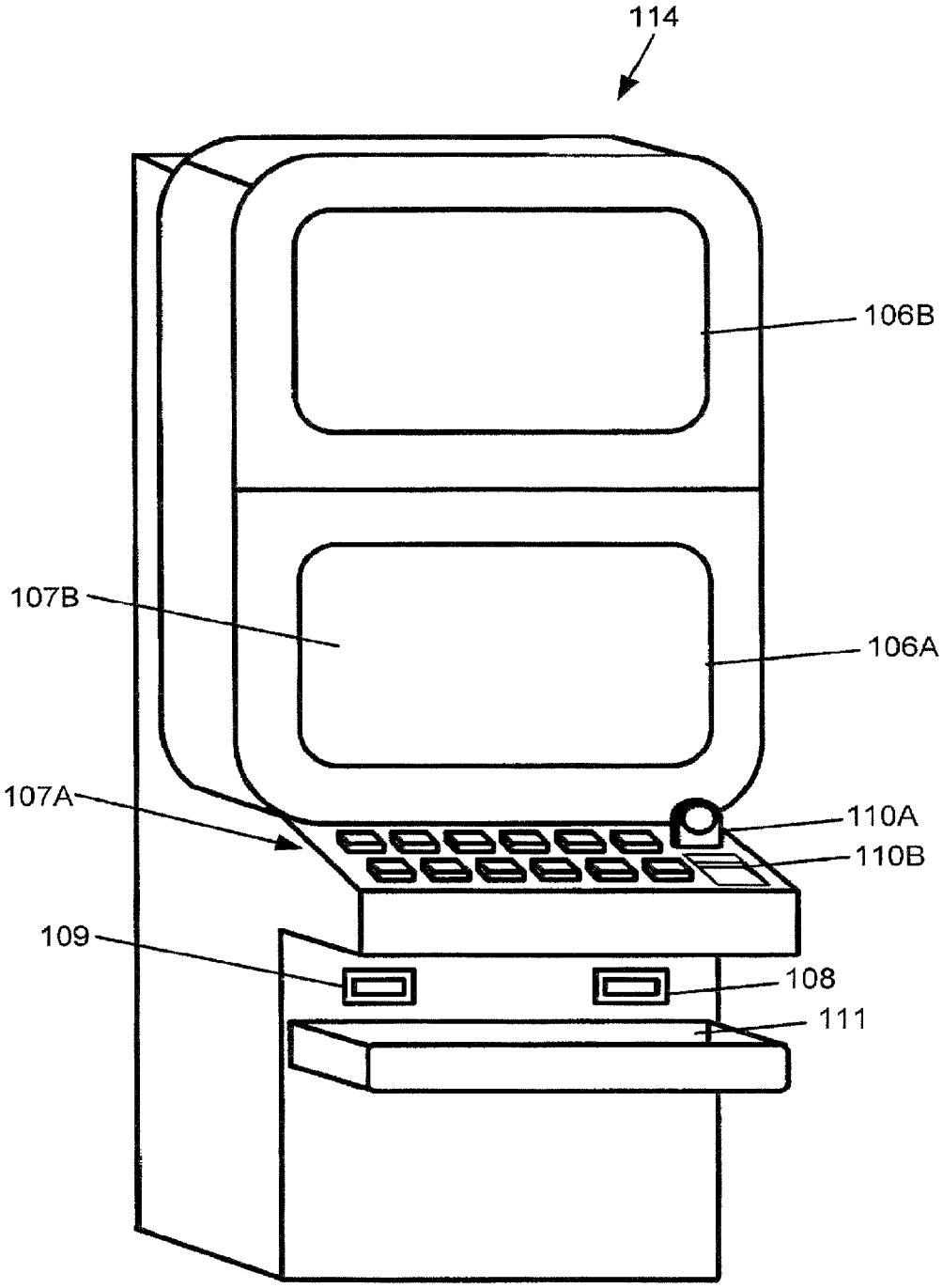
FIG. 1: shows diagrammatically, a view of a gaming console suitable for implementing the present invention.

In FIG. 1 of the accompanying drawings, one example of a gaming console that is suitable to implement the present invention is generally referenced by arrow 114.

The gaming console 114 includes two displays 106A, 106B on one or both of which is displayed representations of a game that can be played by a player and a bank of buttons 107A and/or a touch screen 107B to enable a player to play the game. The displays 106 may be video display units, such as a cathode ray tube screen device, a liquid crystal display, plasma screen, any other suitable video display unit, or the visible portion of an electromechanical device. The display 106B may display artwork, including for example, pay tables and details of bonus awards and other information or images relating to the game. In alternative gaming consoles the display 106B may be omitted, optionally replaced by a static display.

A credit input including a coin input 110A and/or bill collector 110B allows a player to provide credit for wagering and a coin output 111 is provided for cash payouts from the gaming console 114. A card and/or ticket reader 108 and a printer 109 may be provided to provide player tracking, cashless game play or other gaming and non-gaming related functions.

Figure 2:
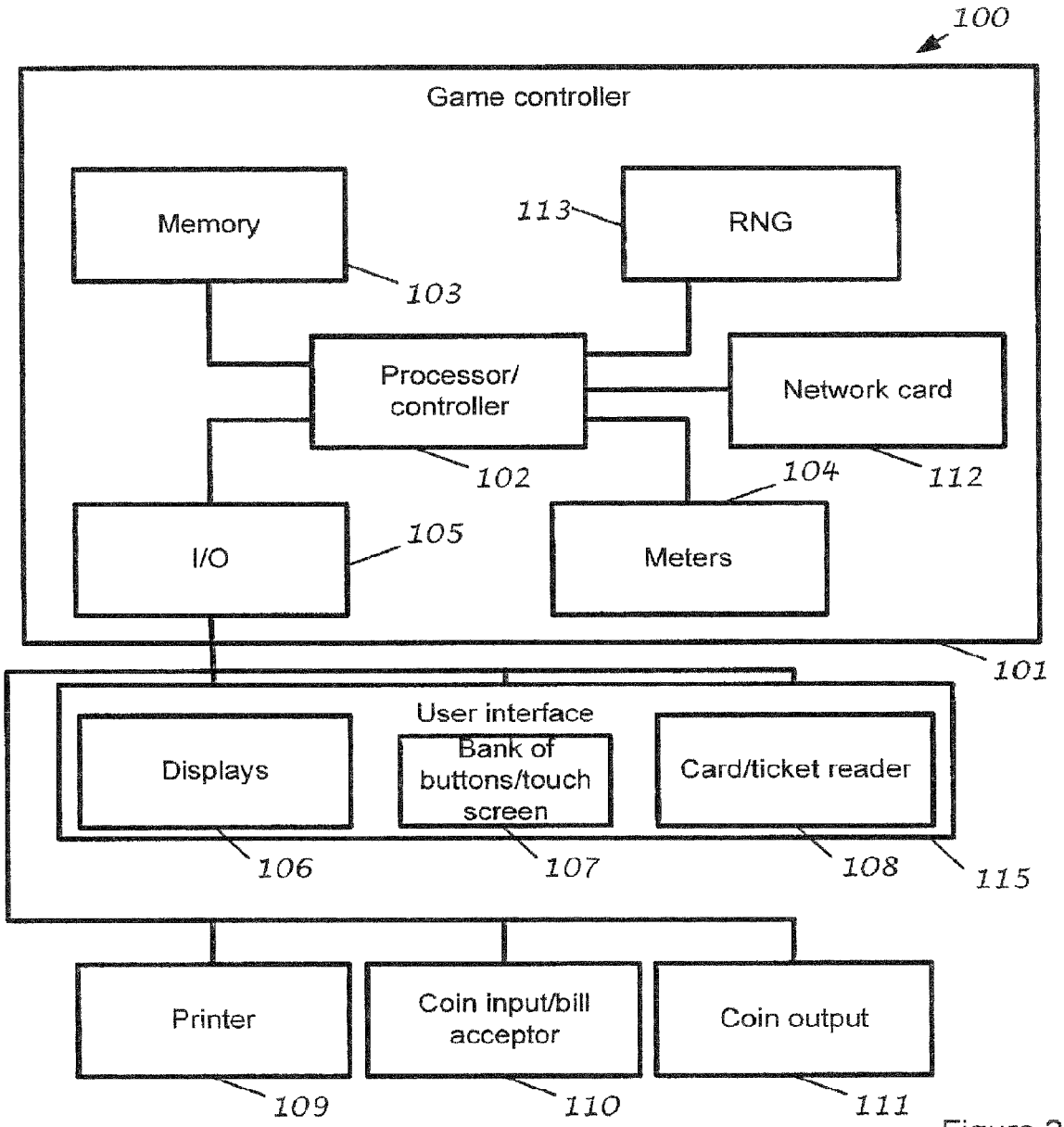
FIG. 2: shows a block diagram of gaming machine suitable for implementing the present invention.

FIG. 2 shows a block diagram of a gaming machine, generally referenced by arrow 100, suitable for implementing the present invention. The gaming machine 100 may include the gaming console 114 shown in FIG. 1 and accordingly like reference numerals have been used to describe like components in FIGS. 1 and 2.

The gaming machine 100 includes a game controller 101, which in the illustrated example includes a computational device 102, which may be a microprocessor, microcontroller, programmable logic device or other suitable device. Instructions and data to control operation of the computational device 102 are stored in a memory 103, which is in data communication with, or forms part of, the computational device 102. Typically, the gaming machine 100 will include both volatile and non-volatile memory and more than one of each type of memory, with such memories being collectively represented by the memory 103. The instructions to cause the game controller 101 to implement the present invention will be stored in the memory 103.

The game controller 101 may include hardware credit meters 104 for the purposes of regulatory compliance and also include an input/output (I/O) interface 105 for communicating with the peripheral devices of the gaming machine 100. The input/output interface 105 and/or the peripheral devices may be intelligent devices with their own memory for instructions and data.

In the example shown in FIG. 2, the peripheral devices that communicate with the controller are the displays 106, bank of buttons/touch screen 107, the card and/or ticket reader 108, the printer 109, a bill acceptor and/or coin input 110 and a coin output 111. Additional devices may be included as part of the gaming machine 100, or devices omitted as required for the specific implementation.

The bank of buttons 107A and/or touch screen 107B together with one or both of the displays 106 may provide a user interface 115 through which the gaming machine 100 and player communicate. If a card/ticket reader 108 is provided, this may also form part of the user interface 115.

In addition, the gaming machine 100 may include a communications interface, for example a network card 112. The network card 112, may for example, send status information, accounting information or other information to a central controller, server or database and receive data or commands from the central controller, server or database. The network card 112 may also enable communication with a central player account, allowing cashless gaming. One or more of the peripheral devices, for example the card/ticket reader 108 may be able to communicate directly with the network card 112. The network card 112 and the I/O interface 105 may be suitably implemented as a single machine communications interface.

The game controller 101 may also include a random number generator 113, which generates a series of random numbers that are used by the computational device 102 to determine the outcomes of games played on the gaming machine 100.

The game controller 101 may have distributed hardware and software components that communicate with each other directly or through a network or other communication channel. The game controller 101 may also be located in part or in its entirety remote from the user interface 115. Also, the computational device 102 may comprise a plurality of devices, which may be local or remote from each other.

Figure 3:
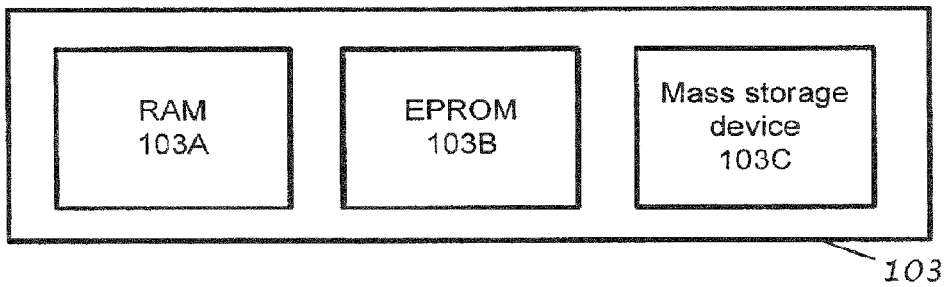
FIG. 3: shows a block diagram of components of the memory of the gaming machine represented in FIG. 2.

FIG. 3 shows an exemplary block diagram of the main components of the memory 103. The RAM 103A typically temporarily holds instructions and data related to the execution of game programs and communication functions performed by the computational controller 102. The EPROM 103B may be a boot ROM device and/or may contain system and game related code. The mass storage device 103C may be used to store game programs, the integrity of which may be verified and/or authenticated by the computational controller 102 using protected code from the EPROM 103B or elsewhere.

Play of Example Game

Figure 4:
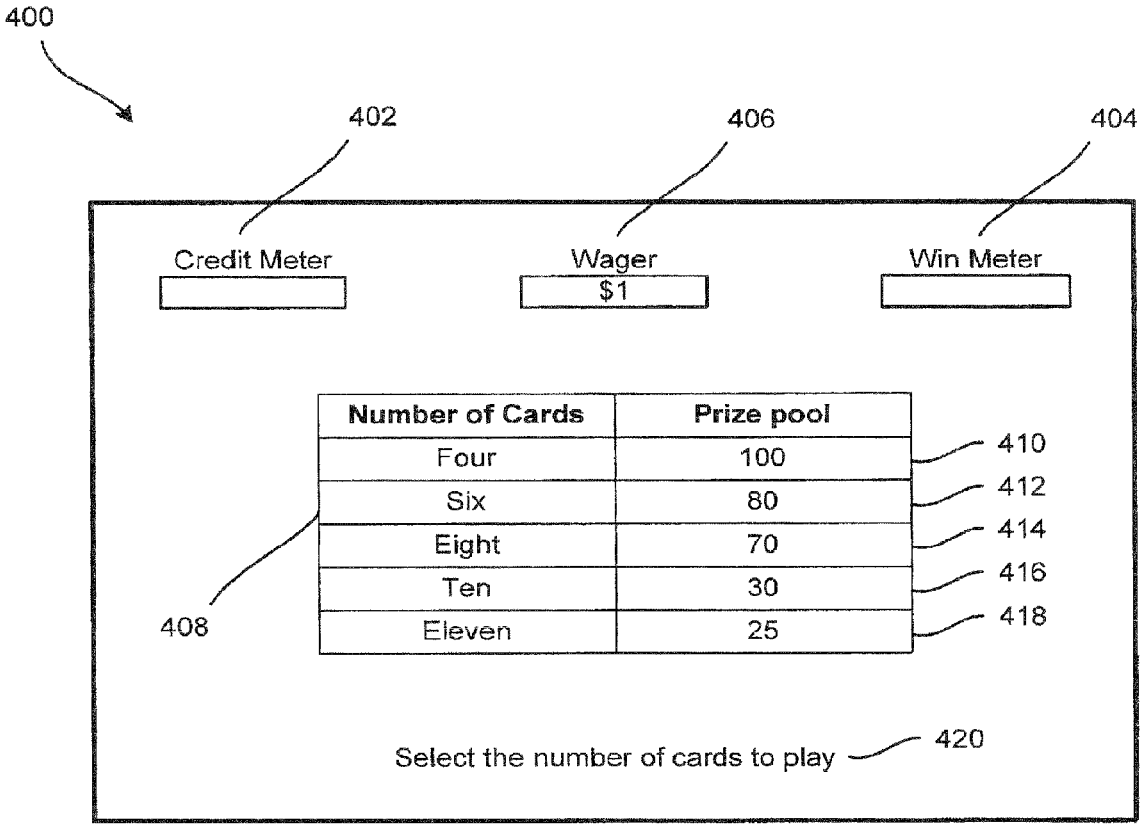
FIG. 4: provides an example screen layout of a selection screen for use in accordance with an embodiment of the present invention.

In one embodiment of the present invention, a player commences play of a game by placing a wager. Once a wager has been placed, the game controller 101 offers the player a selection screen (FIG. 4 provides an example screen layout of the selection screen 400). In the selection screen layout 400, the following are displayed to a player:

- the number of credits available to the player 402
- the winnings of the player 404 for the currently active game
- the value of the wager placed by the player 406
- a selection table 408 showing the various numbers of symbols that may be selected by the player and the prize pools associated with those numbers of symbols As can be seen, in the illustrated example, the prize pools associated with the various numbers of symbols are as follows:

| Number of symbols | Prize pool |
|---|---|
| Four (ref 410) | 100 |
| Six (ref 412) | 80 |
| Eight (ref 414) | 70 |
| Ten (ref 416) | 30 |
| Eleven (ref 418) | 25 |

Determination of the various prize pool values is discussed below.

A prompt 420 is also displayed prompting the player to select the number of symbols they wish to play with.

Using the bank of buttons/touch screen 107 the player selects from the selection table 408 the number of symbols (and therefore also the associated prize pool) that they wish to play the game with. In this case play of the game will be described on the basis that a player has selected to play with four symbols.

In the preferred embodiment of the invention the symbols used by the game are graphical representations of cards, each card having a face and a back. As with traditional physical cards, when the face of a card is on display the value associated with the card is shown, and when the back of a card is on display the value associated with the card is hidden. Accordingly, and for the purposes of describing the play of the various game levels the game symbols will be referred to as cards, however it will be appreciated that any symbol or representation would suffice provided the player can select that symbol or representation without knowing the associated value and, upon selection, be shown the associated value.

Level One

Once the player has selected the number of cards they wish to play with the game controller 101 initializes the first level of the game. Initialization of the level involves setting the prize pool for the level, setting an award multiplier for the level, and setting the value for each of the cards being used in the level.

For the first level, the prize pool is set to the prize pool associated with the number of cards selected by the player (in this case 100). The first level award multiplier is, in this case, set to 0.02, and the values of the four cards are set at:

card 512: 10
card 514: 50
card 516: 30
card 518: 10

The determination and setting of award multipliers and card values is discussed below in greater detail. It is, however, noted here that the sum of the values of all of the cards in the first level is equal to the prize pool for the first level (i.e. 100).

Figure 5A:
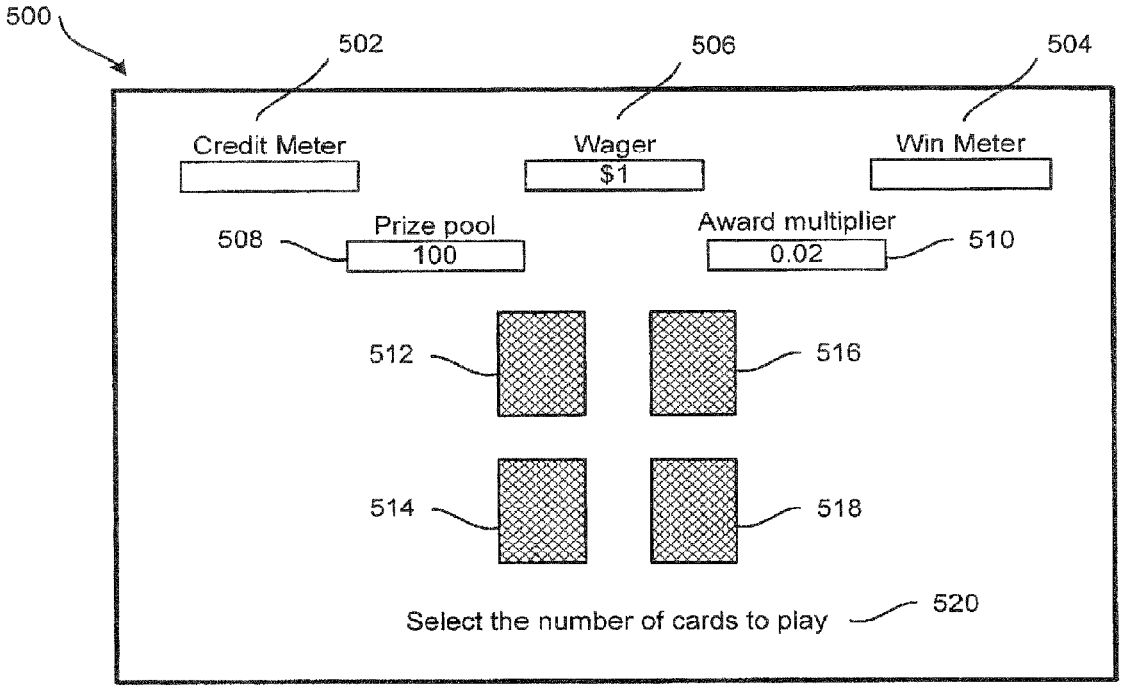
FIG. 5A: provides an example screen layout of the first level of the game of a preferred embodiment of the present invention prior to symbol selection by a player.

Once the prize pool and award multiplier have been set the game controller 101 displays the first level of the game to the player. FIG. 5A provides a representation of a screen layout 500 associated with the first level. In the first level screen layout 500 the following are displayed:

the number of credits available to the player 502
the winnings of the player 504
the value of the wager placed by the player 506
the prize pool associated with the first level 508
the award multiplier associated with the first level 510
four cards 512 to 518 (noting the player elected to play with four cards)

The four cards 512 to 518 are, initially, displayed "face down"—i.e. displayed such that any value associated with the cards is not visible to the player. A prompt 520 is also displayed prompting the player to "select a card" which the player can do using the bank of buttons/touch screen 107.

Figure 5B:
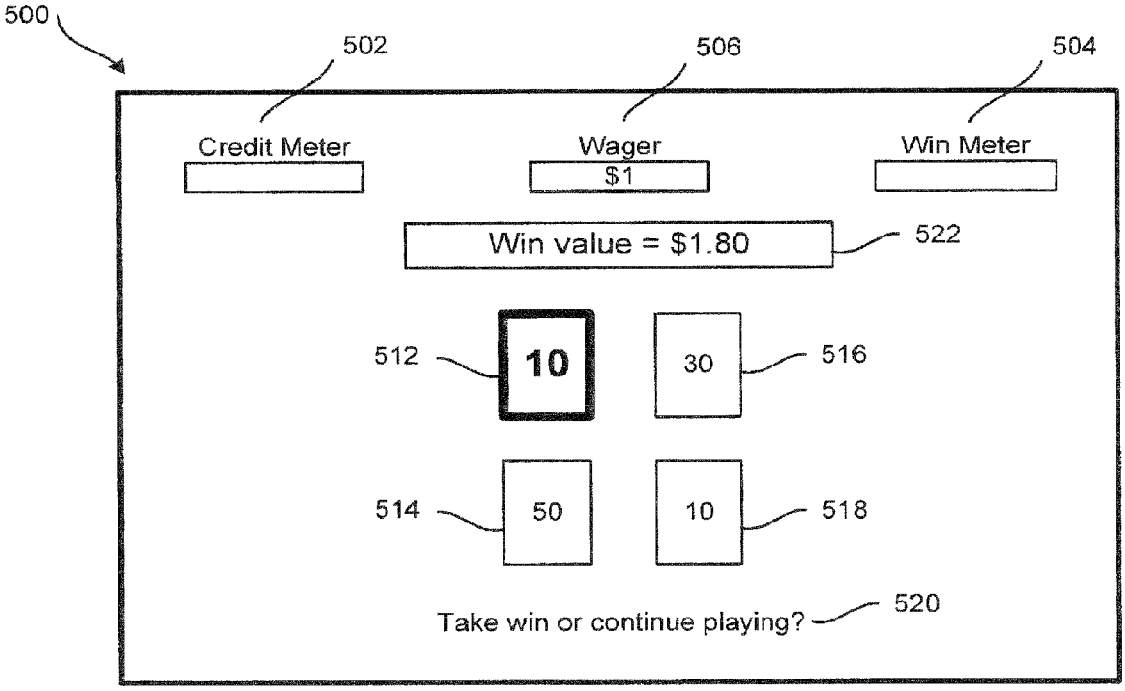
FIG. 5B: provides an example screen layout of the first level of the game shown in FIG. 5A after symbol selection by a player.

Referring now to FIG. 5B, when the player selects one of the cards the card selected by the player is clearly indicated by the game controller 101 and the faces of all of the cards with their associated values are displayed. Any means may be used to clearly indicate the card selected by the player. By way of non-limiting example, the game controller 101 may provide the selected card in a different colour to the other cards, provide the selected card with a different border to the other cards, place text on the display indicating the selected card, or make the selected card larger or smaller than the other cards. In the representations the card selected by the player has been indicated with a heavier border and bolded value.

In this instance the player has selected card 512, with an associated value of 10.

In addition to displaying the values of the cards the game controller 101 also calculates and displays the win value 522 of the first level and asks the player whether they wish to take the win or continue playing 524.

In one embodiment, the win value of the first level (and, in fact, of each level of the game) is calculated by the game controller 101 according to the formula:

$$W=B*A*(P-C)$$

Where:
W=win value
B=the bet (wager) placed by the player
A=award multiplier
P=the value of the prize pool
C=the value of the card selected by the player In the preferred embodiment the win value is a monetary amount, however it would of course be possible to award the win value as credits.

In the example depicted in FIG. 5B the wager placed by the player B=$1, the award multiplier A=0.02, the value of the prize pool P=100, and the value of the card selected by the player C=10. Accordingly, using the formula above, the win value W=$1.80.

If the player elects to take the win (again via use of the bank of buttons/touch screen 107) the win value is transferred to the credit meter 402. If the player elects to "cash out" their credits these are then paid to the player through coin output 111.

In other embodiments different formula may be used to calculate the win value of a particular level. For example, the formula may be set to:

$$W=B*A*C$$

It is, of course, also possible that different win value formulae may be used for different game levels.

Level Two

If the player elects to continue playing, the win value of the first level is forfeited and the second level of the game is launched. Similarly to the first level, the game controller 101 initializes the second level by setting the prize pool, the award multiplier, and the individual card values for the second level.

In one embodiment, the prize pool for the second level is set to the value of the cards not selected by the player in the first level (i.e. P−C) (once again, in alternative embodiments a different formula may be used to calculate the value of the prize pool). In this instance, and referring back to the value of the symbols not selected by the player in the previous level, the prize pool for the second level is 90. The award multiplier associated with the second level is set to 0.05, and the card values associated with the second level are:

card 612: 50
card 614: 10
card 616: 20
card 618: 10

The determination of the values associated with the award multiplier and each individual card is discussed below. As with the first level, the sum of the values of the cards in the second level is equal to the value of the prize pool for the second level (i.e. 90).

Figure 6A:
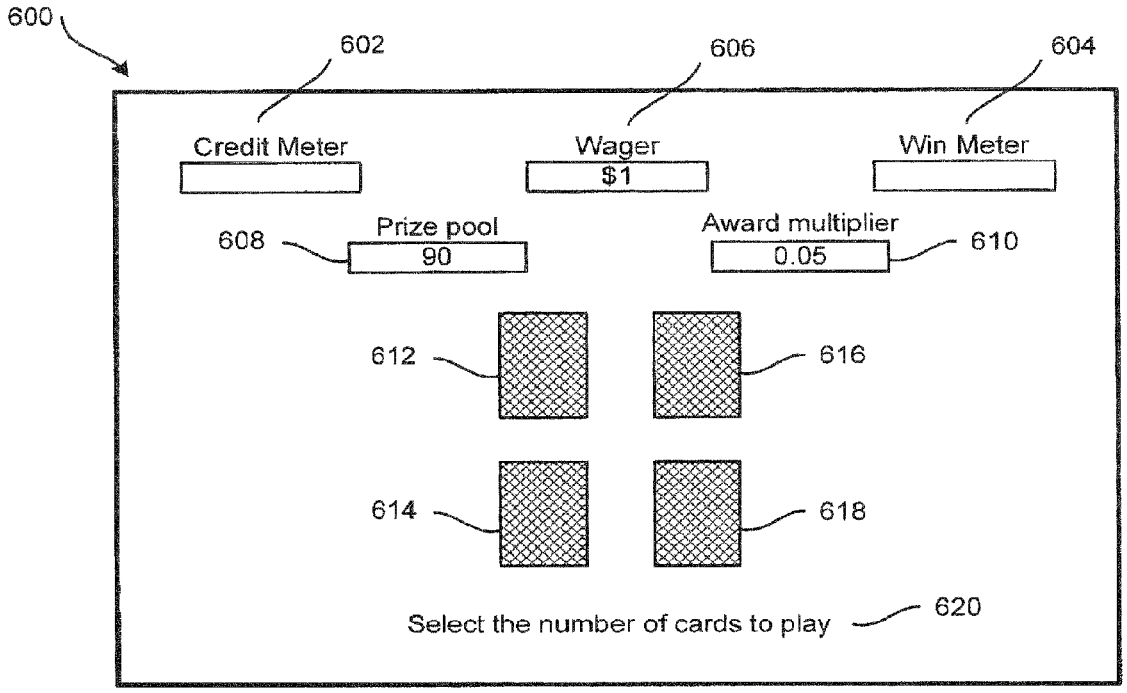
FIG. 6A: provides an example screen layout of the second level of the game of a preferred embodiment of the present invention prior to symbol selection by a player.

The game controller 101 displays the second level of the game to the player. The screen layout 600 for the second level is depicted in FIG. 6A, and is the same as that of the first level with the exception that the values of the prize pool 608 and award multipliers 610 now reflect the updated values for the second level.

Figure 6B:
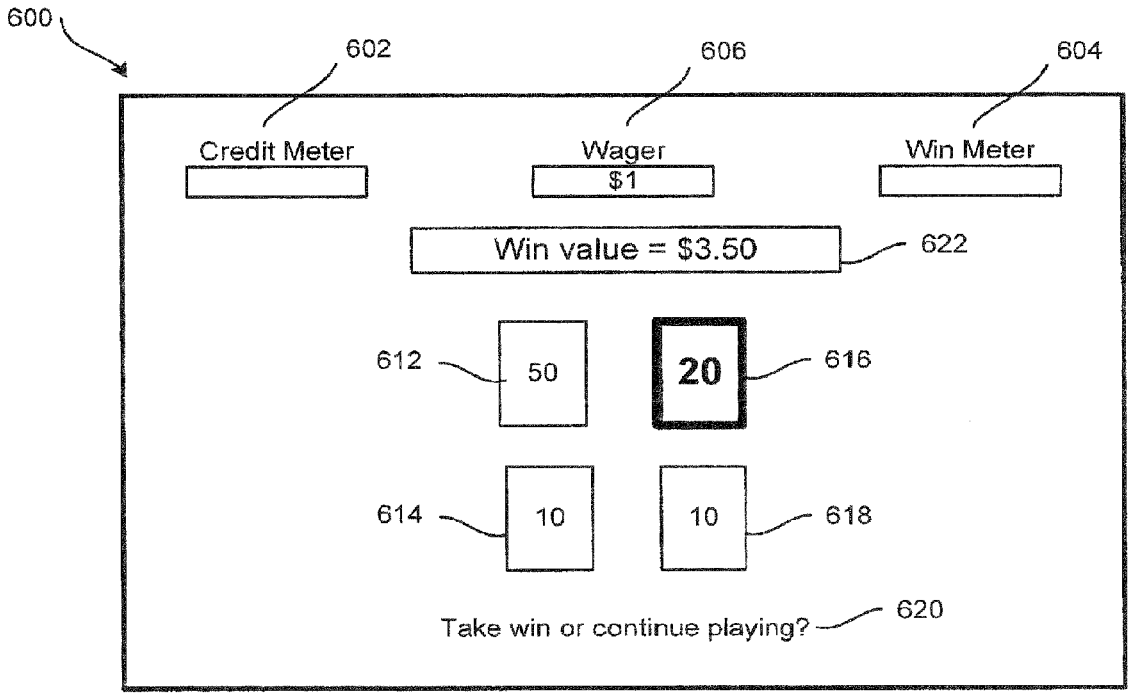
FIG. 6B: provides an example screen layout of the second level of the game shown in FIG. 6A after symbol selection by a player.

Once again the four cards 612 to 618 are displayed "face down" and the player is prompted to "select a card". Referring to FIG. 6B, once the player has selected a card the selected card is clearly indicated by the game controller 101 and the faces of all of the cards are displayed. In this instance the player has selected card 616 with an associated value of 20.

In addition to displaying the values of the cards the game controller 101 also calculates and displays the win value 622 of the first level and asks the player whether they wish to take the win or continue playing 624.

The win value is calculated according to the same formula used for the calculation of the win value in level one. In this instance:

the wager placed by the player B=$1
the award multiplier A=0.05
the value of the prize pool P=90
the value of the card selected by the player C=20.

Accordingly the win value W=$3.50. If the player elects to take the win this value is transferred to the credit meter 402. Once again, an alternative formula may be used to calculate the win value.

Level Three

If the player elects to continue playing, the win value of the second level is forfeited and the third level of the game is launched. As described above, the game controller 101 initializes the third level by setting the prize pool, award multipliers, and individual card values for the third level.

The prize pool for the third level is, in this embodiment, set to the value of the cards not selected by the player in the third level (i.e. P−C). In this instance, therefore, the prize pool for the second level is 70. The award multiplier associated with the second level is, in this instance, set to 0.5, and the individual card values are set to:

card 712: 30
card 714: 10
card 716: 20
card 718: 10

As with the first and second levels, the sum of the values of the cards in the third level is equal to the value of the prize pool for the third level (i.e. 70).

Figure 7A:
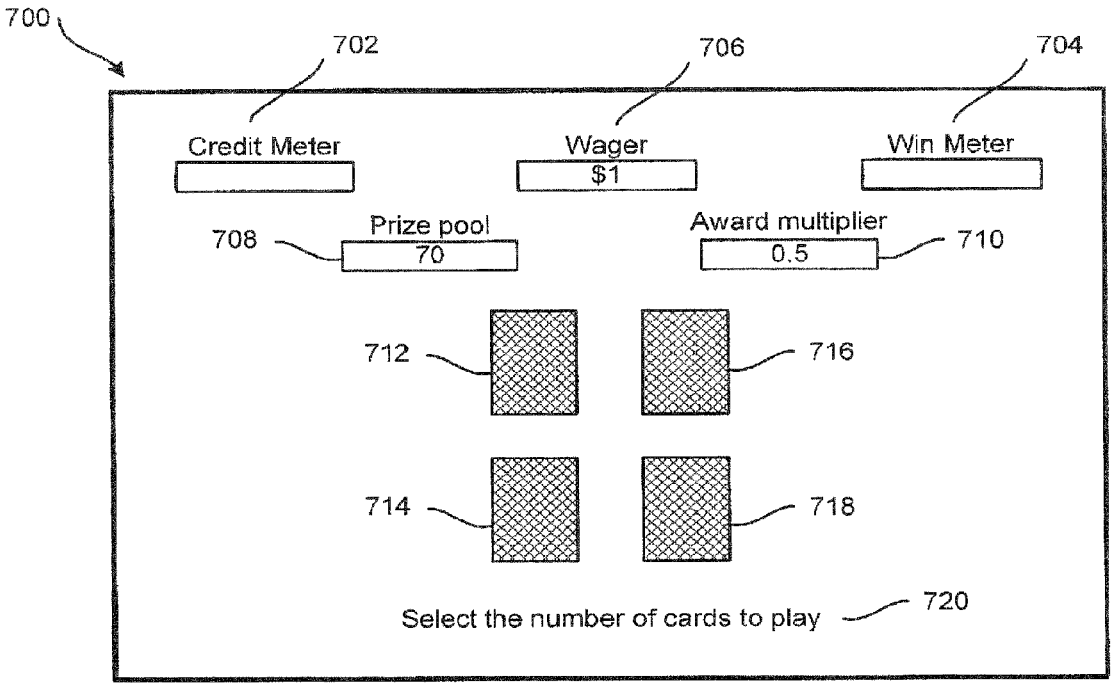
FIG. 7A: provides an example screen layout of the third level of the game of a preferred embodiment of the present invention prior to symbol selection by a player.

The game controller 101 displays the third level of the game to the player. The screen layout 700 for the third level is depicted in FIG. 7A, and is the same as that of the first and second levels with the exception that the values of the prize pool 708 and award multipliers 710 reflect the updated values for the third level.

Figure 7B:
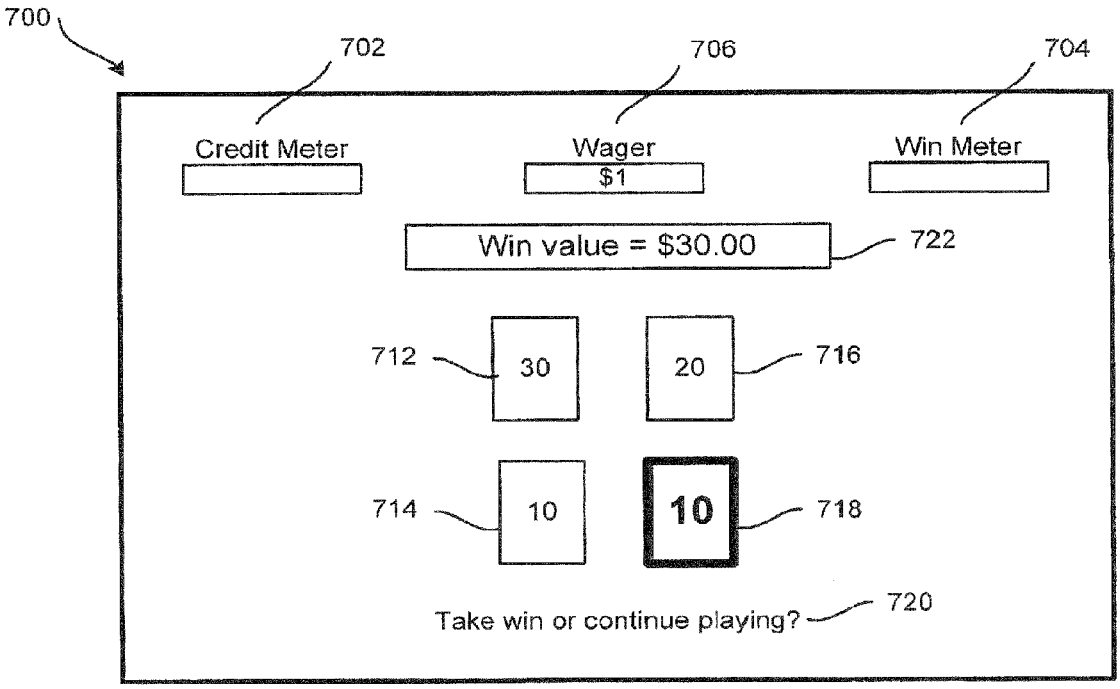
FIG. 7B: provides an example screen layout of the third level of the game shown in FIG. 7A after symbol selection by a player.

Once again the four cards 712 to 718 are displayed "face down" and the player is prompted to "select a card". Referring to FIG. 7B, once the player has selected a card the selected card is clearly indicated by the game controller 101 and the faces of all of the cards are displayed. In this instance the player has selected card 718 with an associated value of 10.

In addition to displaying the values of the cards the game controller 101 also calculates and displays the win value 722 of the first level and asks the player whether they wish to take the win or continue playing 724.

The win value is calculated according to the same formula used for the calculation of the win value in the previous levels. In this instance:

the wager placed by the player B=$1
the award multiplier A=0.5
the value of the prize pool P=70
the value of the card selected by the player C=10.

Accordingly the win value W=$30. If the player elects to take the win this value is transferred to the credit meter 402.

Level Four (Final Level)

If the player elects to continue playing, the win value of the third level is forfeited and the fourth level of the game is launched. Similarly to the previous levels, the game controller 101 initializes the fourth level by setting the prize pool, the award multiplier, and the values of the individual cards for the fourth level.

In this embodiment the prize pool for the fourth level is set to the value of the cards not selected by the player in the third level (i.e. P−C). In this instance, therefore, the prize pool for the fourth level is 60. The award multiplier associated with the fourth level is set to 1.6, and the card values for the fourth level are set to:

card 812: 30
card 814: 0
card 816: 20
card 818: 10

As with the previous levels, the sum of the values of the cards in the fourth level is equal to the value of the prize pool for the second level (i.e. 60).

Figure 8A:
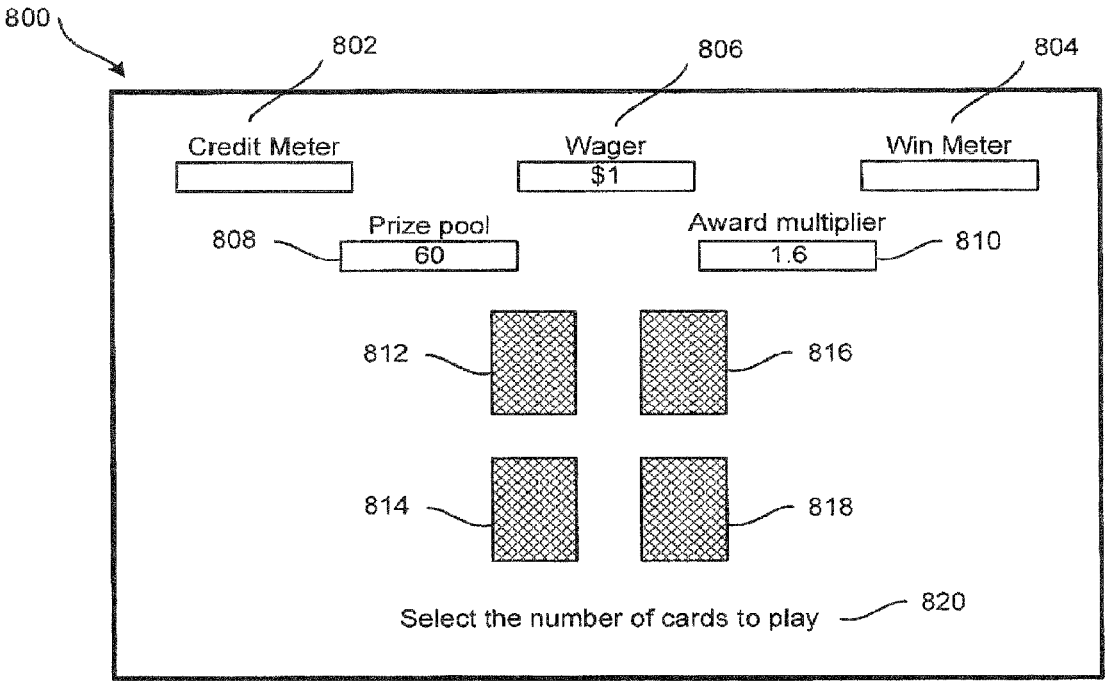
FIG. 8A: provides an example screen layout of the fourth level of the game of a preferred embodiment of the present invention prior to symbol selection by a player.

The game controller 101 displays the fourth level of the game to the player. The screen layout 800 for the fourth level is depicted in FIG. 8A, and is the same as that of the previous levels, again with the values of the prize pool 808 and award multipliers 810 now reflect the updated values for the fourth level.

Figure 8B:
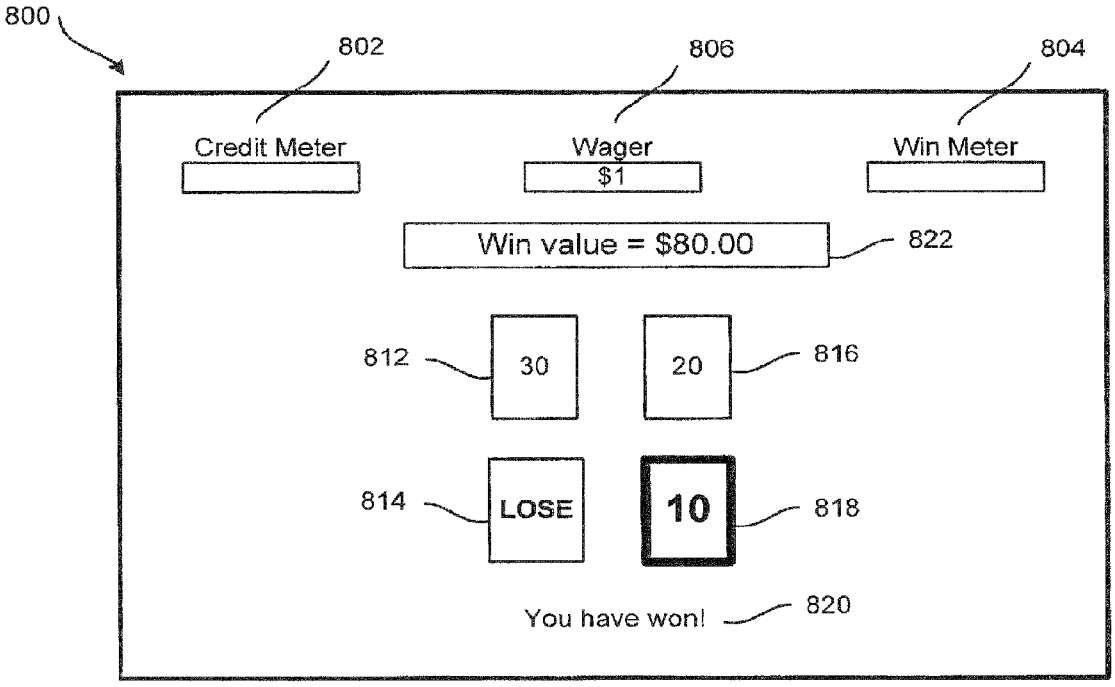
FIG. 8B: provides an example screen layout of the fourth level of the game shown in FIG. 8A after symbol selection by a player.

Once again the four cards 812 to 818 are displayed "face down" and the player is prompted to "select a card". Referring to FIG. 8B, once the player has selected a card the selected card is clearly indicated by the game controller 101 and the faces of all of the cards are displayed. In this instance the player has selected card 818 with an associated value of 10.

In addition to displaying the values of the cards the game controller 101 also calculates and displays the win value 822 of the fourth level. In the preferred embodiment the fourth level is the final level and the player must take the win value (i.e. the player cannot play on to a further level) and the game controller 101 indicates to the player they have won 820.

The win value is calculated according to the same formula used for the calculation of the win value in level one. In this instance:

the wager placed by the player B=$1
the award multiplier A=1.6
the value of the prize pool P=60
the value of the card selected by the player C=10.

Accordingly the win value W=$80 which is paid to the player through coin output 111.

As can be seen, in level four the value of one of the cards (card 814) is a losing card. Had the hypothetical player selected this card the win value of level four would be $0, and no award would be paid out (noting, as described above, that by advancing a level in the game the potential winnings of earlier levels are forfeited). While a losing card has only been introduced into the final level in this particular embodiment it would, of course, be possible to include losing cards in any level of the game.

Accordingly, while each successive level in the game provides the potential for higher awards, they also introduce the possibility that no award will be won. Further, as will be appreciated, in the described embodiment the value of the cards not selected by the player is instrumental both in calculations of the win value for each level and the prize value for the next level should the player elect to continue play.

Alternative Final Level

In an alternative embodiment, if a player progresses to the final level of the game they may be provided with a chance to win a special jackpot or major prize not determined according to the above formula.

For example, in the final level of a four card game the game controller 101 may be configured (as discussed below) to set the value of three of the cards to be losing cards. If the player then selects the card with a value (i.e. the winning card) the player may be awarded the major prize for the four card game. The major prize may, for example, be a fixed value prize, a progressive prize, or a non-cash prize.

Alternatively, card values and the win value of the level may be ascribed in the normal fashion, however if the player selects the card with the highest value (or equal highest value) they are awarded the major prize instead of the win value. For example, if the final level of an eleven card game is being played with a prize pool of three, nine of the cards may be set to be losing cards, one of the cards may be set with a value of 2, and one of the cards may be set with a value of one. Only if the player selects the card with the value of two (i.e. the highest value card, in this instance a 1 out of 11 chance) is the major prize awarded. If the player selects the card with the value of one (a 1 out of 11 chance) the ordinary win value is calculated and awarded, and if the player selects a losing card (a 9 out of 11 chance) no prize is awarded.

Alternative "Losing" Condition

If desired, instead of exiting the game when a player who "loses" (as described above) the game controller 101 may return the player to a previously played level. The game controller 101 may automatically return the player to a previous level, or may offer the player a choice as to whether they would like to return to a previous level and require payment from the player to do so (e.g. by requiring a certain number of credits or a particular wager).

For example, if the player has advanced to level four and "loses" the game, the controller 101 may automatically return the player to level two. Alternatively, the game controller may provide the player with the option of paying X credits to return to level two or Y credits (Y preferably >X) to return to level three (or, of course, no credits to exit the game).

Prize Pool Values

As discussed above, at the beginning of a game a player is provided with the option to select the number of symbols they wish to play the game with, and associated with each number of symbols is the initial value of the prize pool for that game (i.e. the prize pool value for level one).

Preferably the values of these initial prize pools are precalculated (for example by the game designer) and stored in a lookup table or similar which is accessed by the game controller 101 when displaying the selection screen 400.

As can be seen, as the number of symbols to be used in the game increases the value of the initial prize pool decreases. This is to account for the fact that when a prize pool is distributed between a greater number of symbols, the value of a single symbol selected by a player is likely to be a smaller percentage of the total prize pool (and, consequently, the value of the remaining symbols not selected by a player a greater percentage of the prize pool).

As in the example described above, one possible lookup table for the initial prize pools associated with various numbers of symbols could be:

| Number of symbols | Initial prize pool |
|---|---|
| Four | 100 |
| Six | 80 |
| Eight | 70 |
| Ten | 30 |
| Eleven | 25 |

As described above, if a player elects to play beyond level one, the prize pool associated with level N (N>1) is calculated according to the value of the symbols not selected by the player in the preceding level (i.e. level N−1).

Accordingly, the prize pool for level N (N>1) is the value of the prize pool for the preceding level (level N−1) minus the value of the symbol selected by the player in level N−1.

Award Multipliers

The award multiplier for each level may be also be precalculated by the game designer and entered into a memory as part of the rules of the game. The award multiplier may, for example be stored in a lookup table or similar for access by the game controller 101. In order to entice a player to play to higher levels of the game (i.e. by forfeiting the win of level N and electing to play on to level N+1) the award multipliers in the preferred embodiment of the invention increase as the player progresses through game levels. In other words, the award multiplier for level N+1 is greater than the award multiplier for level N.

As per the example described above, a suitable lookup table for the award multipliers to be associated with each level could be:

| Level | Award multiplier |
|---|---|
| One | 0.02 |
| Two | 0.05 |
| Three | 0.5 |
| Four | 1.6 |

Symbol Values

The values associated with each of the symbols in each level of the game may be predefined (e.g. by the game designer) and stored in a look-up table or similar, or may be determined by use of the random number generator 113.

As has been described above, the game controller 101 knows the value that the sum of all the symbol values must be for any given level (i.e. the value of the prize pool for that level). As the game controller 101 also knows how many symbols the value of the prize pool must be distributed between (due to the player selection of the number of symbols), the game controller 101 can obtain from the random generator 113 the number of required values such that the sum of those values is equal to the value of the prize pool for the level.

For example, in level 3 as described above the game controller 101 would request from the random number generator 113 four values the sum of which would equal 70. If the random generator 113 returns any zero values, the game controller 101 may be configured to deal with these in one of two ways depending on the level:

- the game controller 101 may assign a symbol a zero value (this would then be the optimal symbol selection for the player); or
- the game controller may interpret any zero value as a "losing" symbol.

If any zero values returned by the random generator 113 are to be interpreted as zero values, the game controller 101 is further configured to introduce "losing" cards via a separate procedure. This may be a lookup table or similar which provides the number of losing symbols to be displayed in any given level. In this instance the number of losing symbols is deducted from the total number of symbols in play and the prize pool is distributed between the remaining symbols.

Once the game controller 101 has determined the required symbol values these can be associated with the game symbols in any conventional manner.

In addition to requiring a number of values which sum to a particular prize pool, the game controller 101 may set additional criteria on the required values. These criteria may be based on compliance with customer or regulatory requirements, be set due to the particular level being played, or may be set due to a particular event. For example:

- for the first level of any game the game controller may require that none of the cards is a losing card. Clearly if there are no losing cards the player is assured a win value regardless of which symbol they select.
- for the last level of the game (i.e. the level with the highest possible award) the game controller 101 may require that a certain percentage of the symbols be losing symbols. For example, if a player is playing a six symbol game the game controller 101 may be set to require half of the symbols (i.e. three symbols) be set with a losing value.

Game Process Flow Diagram

Figure 9:
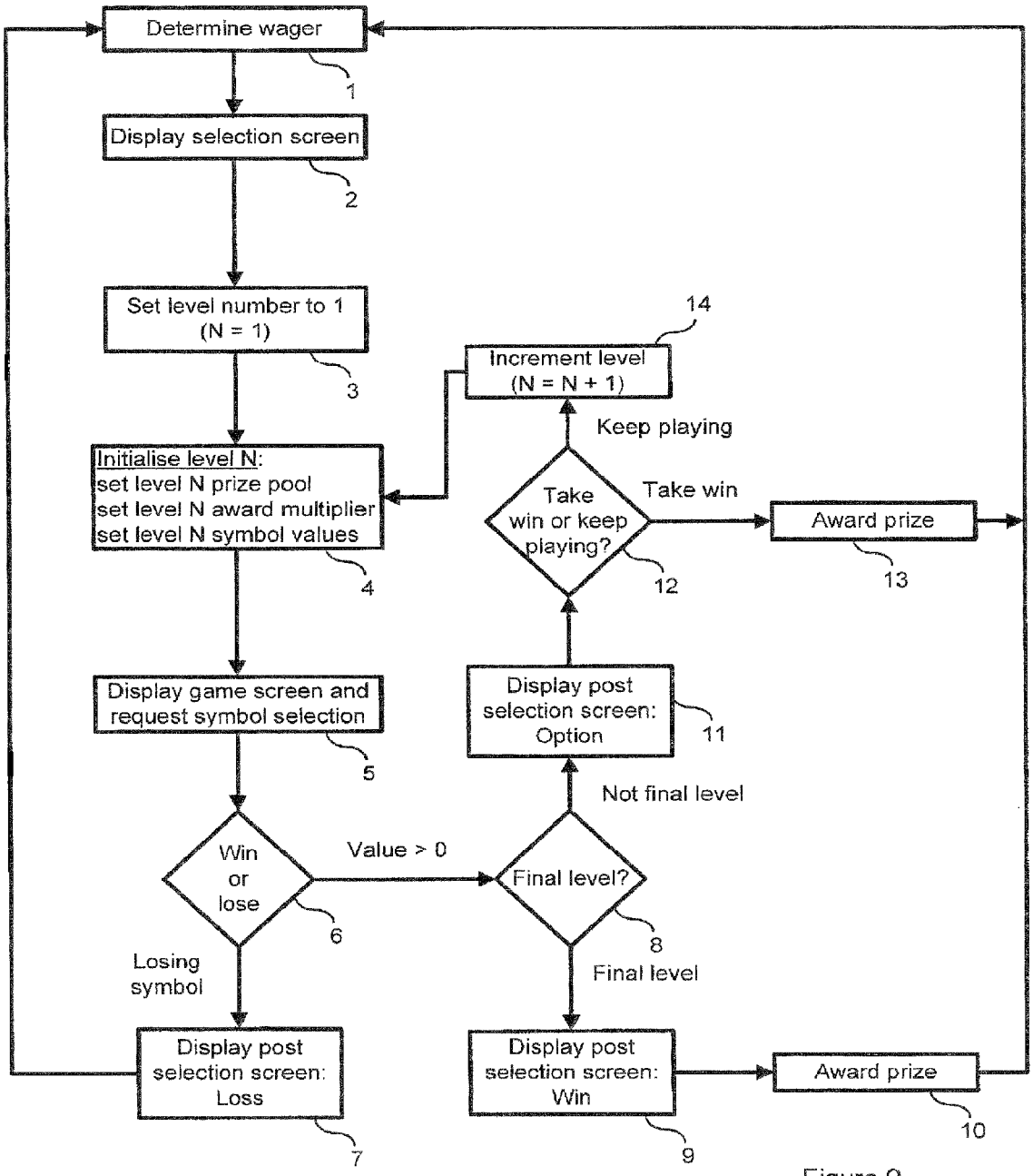
FIG. 9: shows a flow diagram of a process performed in accordance with an embodiment of the present invention.

FIG. 9 provides a process flow diagram of a process performed by the game controller 101 in accordance with an embodiment of the present invention. In step 1, the game controller 101 monitors the bill acceptor and/or coin input 110 and/or information received by the card/ticket reader 108 or network card 112 for a deposit of credit and in response causes the hardware meters 104 to increment according to the denomination of the game. The game controller 101 then monitors the user interface 107 for the input of a wager by a player of the game machine 100.

Once a wager has been detected, the game controller 101 provides the player with a selection screen allowing the player to choose the number of symbols they wish to play the game with and, consequently, the prize pool associated with the first level of the game (step 2).

Once the player has selected the number of symbols they wish to play with, the game controller 101 initialises the game level to level 1 (i.e. N=1) (step 3). The game controller 101 then initialises the level by setting the prize pool, the award multiplier, and determining the values of the symbols to be used for the level (step 4). The manner in which the prize pool, award multiplier, and symbol values are determined is discussed above.

In step 5 the game controller 101 then displays the game screen for the level and requests the player to select a symbol (recalling, at this stage, that the game symbols are displayed with their associated values hidden from the player).

Once the player has selected a symbol, the game controller 101 determines whether the symbol selected by the player is associated with a value (i.e. a winning symbol) or is a losing symbol (step 6). If the value of the symbol selected by the player is a losing symbol, the game controller 101 displays post-symbol selection game screen, including the values associated with each of the symbols (highlighting the symbol and associated value selected by the player) and an indication that player has lost the game (step 7). The player can then restart the game at step 1 should they wish. As discussed above, the game controller 101 could alternatively be configured to allow the player to replay previous levels of the game.

If a value is associated with the symbol selected by the player, the game controller in step 8 determines whether the player is presently playing the last level of the game (i.e. whether N=the total number of levels playable). If the player is playing the last level of the game, the game controller 101 displays the values associated with the symbols (highlighting the symbol and associated value selected by the player), displays the prize won by the player, and indicates to the player they have won the game (step 9). The game controller 101 the awards the player their prize (step 10) and the player can then restart the game at step 1 should they wish.

If there is a value associated with the symbol selected by the player and the level being played by the player is not the last level of the game (i.e. N<the total number of levels), the game controller 101 displays the values associated with the symbols (highlighting the symbol and associated value selected by the player) and displays the award value calculated according to the value associated with the symbol selected by the player (step 11). The game controller 101 also offers the player the option taking the award value or forfeiting the award and continuing play of the game (step 12).

If the player elects to take the award value, the game controller 101 awards the award value to the player (step 13) and returns to the beginning of the game process (step 1). If the player elects to forfeit the award value and continue play, the game controller 101 increments the level number (i.e. N=N+1) in step 14 and returns to step 4 to initialise the new game level and continue play.

While the game of the preferred embodiment of the present invention has been described as a stand alone game, it will of course be appreciated that the described game may be a bonus game launched from a base game. In this case, for example, a player playing a base game may achieve a special winning combination that causes the game controller 101 to launch the above described game as a bonus game. If played as a bonus game, the wager for the bonus game may be set at whatever wager the player had placed on the base game from which the bonus game was launched. Alternatively, the player may be prompted to enter a wager for the bonus game.

While the foregoing description has been provided by way of example of the preferred embodiments of the present invention as presently contemplated, which utilise gaming machines of the type found in casinos, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

What is claimed is:

1. A gaming machine comprising:

a user interface, and a game controller in communication with said user interface, said game controller providing a game, the game including a plurality of levels, each level associated with a respective one of a plurality of prize pools, and each level having a plurality of player selectable symbols, wherein prize pools associated with higher numbers of player selectable symbols have a lower total value than prize pools associated with lower numbers of player selectable symbols, at least one of said player selectable symbols being associated with an associated value, and wherein accumulative values associated with each of the plurality of player selectable symbols associated with a prize pool are equal to a total value of the associated prize pool; and said game controller displaying said plurality of player selectable symbols for selection of a symbol by the player, said game controller using said associated symbol value to calculate a winning value, said controller offering the player the choice of taking said winning value or progressing to a next level of said plurality of levels, said winning value being calculated using at least one value associated with at least one of the selected symbols of the plurality of player selectable symbols.

2. A gaming machine according to claim 1 wherein said controller calculates the prize pool of the next level using at least one value associated with a completed level.

3. A method using a gaming machine comprising:

staking of a wager by a player;

playing a game including a plurality of levels, each level being associated with a respective one of a plurality of prize pools, and each level having a plurality of player selectable symbols, wherein prize pools associated with higher numbers of player selectable symbols have a lower total value than prize pools associated with lower numbers of player selectable symbols, at least one of said player selectable symbols being associated with an associated value, and wherein the accumulative values associated with each of the plurality of player selectable symbols associated with a prize are equal to the total value of the associated prize pool;

during play of a level by the player, selecting a symbol from the plurality of player selectable symbols; and calculating a winning value associated with the selected symbol; and offering the player a choice of taking the winning value or progressing to a next level.

4. A method according to claim 3 wherein each level includes at least one non-selected symbol.

5. A method according to claim 4 wherein said winning value is calculated using all values associated with non-selected symbols.

6. A method according to claim 5 wherein each level of the game is played with the same number of symbols.

* * * * *